US006216403B1

(12) United States Patent
Belbeoc'h

(10) Patent No.: US 6,216,403 B1
(45) Date of Patent: Apr. 17, 2001

(54) METHOD, MEMBER, AND TENDON FOR CONSTRUCTING AN ANCHORING DEVICE

(75) Inventor: Hervé Belbeoc'h, Versailles (FR)

(73) Assignee: VSL International AG, Lyssach (CH)

( * ) Notice: Subject to any disclaimer, the term of this patent is extended or adjusted under 35 U.S.C. 154(b) by 0 days.

(21) Appl. No.: 09/244,938

(22) Filed: Feb. 4, 1999

(30) Foreign Application Priority Data

Feb. 9, 1998 (EP) ..... 98810096

(51) Int. Cl.[7] ..... E04C 1/40

(52) U.S. Cl. ..... 52/223.13; 52/223.14; 52/295; 52/576; 52/577; 52/742.1; 52/742.14; 52/745.21

(58) Field of Search ..... 52/223.13, 223.14, 52/295, 698, 707, 742.1, 742.14, 742.15, 745.21, 576, 577

(56) References Cited

U.S. PATENT DOCUMENTS

| | | | | |
|---|---|---|---|---|
| Re. 34,350 | * | 8/1993 | Dufossez | 52/223.13 X |
| 1,520,840 | * | 12/1924 | Murray | 52/577 X |
| 1,585,430 | * | 5/1926 | Smith et al. | 52/576 X |
| 1,708,555 | * | 4/1929 | Smith | 52/576 X |
| 2,341,922 | * | 2/1944 | King et al. | 52/223.13 X |
| 2,371,882 | * | 3/1945 | Freyssinet | 52/223.13 |
| 3,388,509 | * | 6/1968 | Mora | 52/577 X |
| 3,403,594 | * | 10/1968 | Newell | 52/745.21 X |
| 3,820,832 | * | 6/1974 | Brandestini et al. | 52/223.13 X |
| 4,043,133 | | 8/1977 | Yegge . | |
| 4,114,329 | * | 9/1978 | Fischer et al. | 52/742.15 X |
| 4,484,425 | * | 11/1984 | Muller | 52/223.13 |
| 4,594,827 | * | 6/1986 | Finsterwalder | 52/223.13 |
| 5,056,284 | | 10/1991 | Ruckdeschel et al. . | |
| 5,630,301 | * | 5/1997 | Sieg | 52/223.13 |

FOREIGN PATENT DOCUMENTS

| | | | |
|---|---|---|---|
| 300486 | | 10/1954 | (CH) . |
| 618328 | | 4/1930 | (DE) . |
| 839026 | | 1/1951 | (DE) . |
| 2743778 | * | 4/1979 | (DE) ..... 52/742.1 |
| 8011939 | | 8/1980 | (DE) . |
| 4437104 | | 11/1995 | (DE) . |
| 0050817 | | 5/1982 | (EP) . |

* cited by examiner

*Primary Examiner*—Carl D. Friedman
*Assistant Examiner*—Phi Dieu Tran A
(74) *Attorney, Agent, or Firm*—Oldham & Oldham, Co., LPA

(57) ABSTRACT

An anchoring device not accessible from one of its sides can be produced by making a cavity (11) of a particular shape and using tendons (4), each of which has an end portion (41) of adapted shape. The cavity may be made in different ways, especially by concreting an anchor member (1) having an opening (12) at one end, the anchor member and the cavity it contains each having an adapted shape. After the anchor member has been concreted and the tendons inserted in the cavity, the cavity is filled with an embedding mortar in order to block the ends of the tendons therein.

10 Claims, 6 Drawing Sheets

METHOD, MEMBER, AND TENDON FOR CONSTRUCTING AN ANCHORING DEVICE

Figure 1:
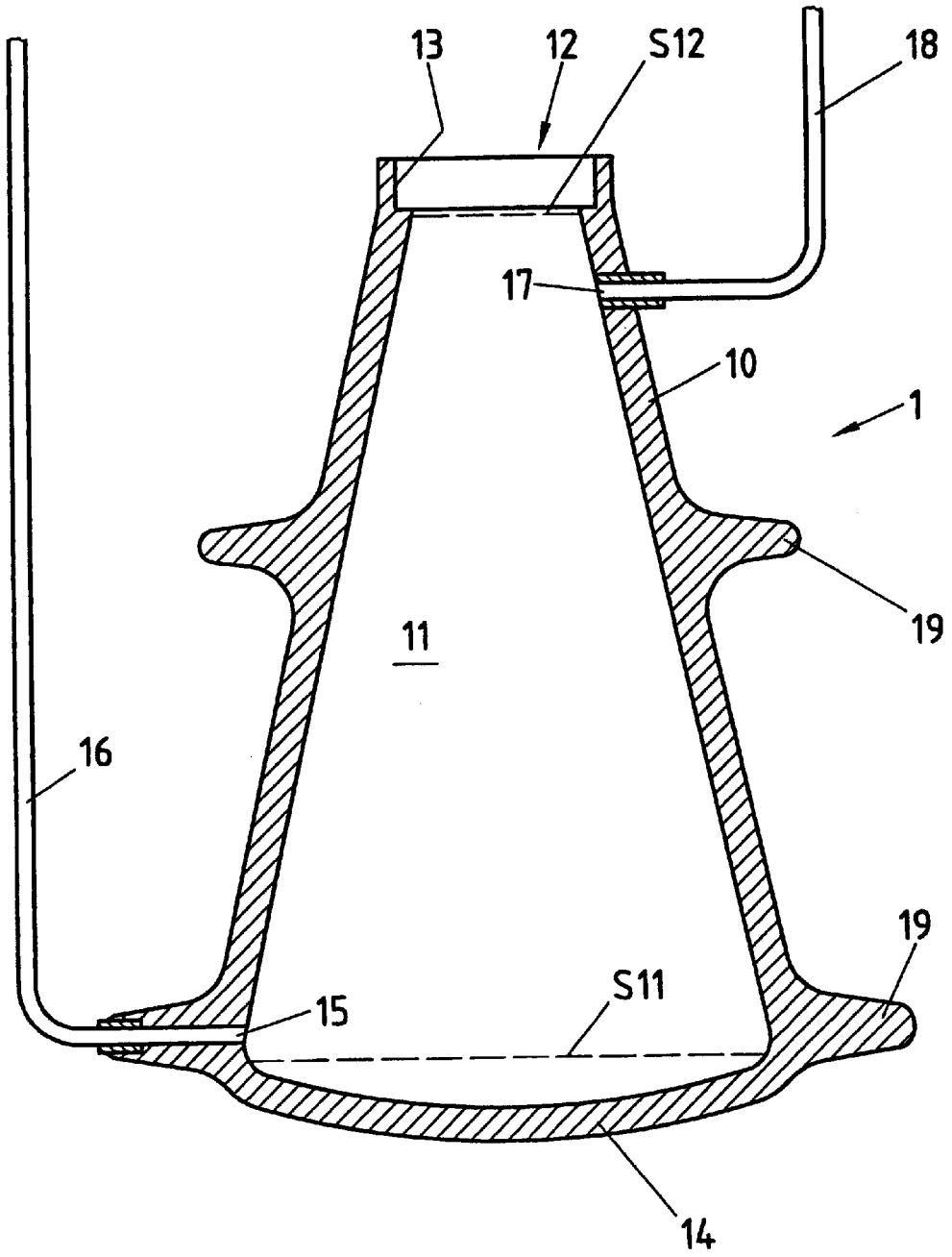

This invention relates to anchoring apparatus used in civil engineering, especially so-called blind anchoring devices accessible from only one side, and more particularly to a method of constructing such a device of the type having more than one tendon, as well as to an anchor member for constructing such a device. The invention further relates to a tendon of the type having one end intended to be inserted into an anchoring cavity of such an anchoring device.

BACKGROUND OF THE ART

For certain anchoring devices having an anchor head with a tendon, prestressed or not, it is not possible to gain access to the anchoring device from the rear. This situation is encountered particularly in the case of a buried anchoring device where access is possible only from the surface of the ground, or when fluid-tightness or anticorrosion protection must be especially meticulous, so that the rear side of the device must be closed. This requirement prevents the use of a conventional anchor plate where the attachment of the tendon to the plate, e.g., with the aid of anchoring cones, calls for the development of new types of anchoring.

U.S. Pat. No. 5,056,284 shows an anchoring device accessible from only one side, the drawback of the device described there being that each tendon, hence the tube in which they are inserted, is held solely by longitudinal adhesion, thus greatly limiting the tractive stress which such an anchoring device can withstand and leading to a very great anchoring length to obtain a sufficient adhesion surface.

Likewise, U.S. Pat. No. 4,043,133 provides a tendon sheathing held solely by longitudinal adhesion to the surrounding earth. The tendons extend from the bottom end of the sheathing and are all attached to an anchor plate; the way in which this plate is inserted in the cavity, and the way in which the tendons are fastened to the plate, are not described. In case this embodiment can be produced, the transmission of the anchor force to the ends of the tendons in the surrounding earth through the injected sheathing is produced solely by longitudinal adhesion, without benefiting from the wedge effect as described below in connection with the present invention.

It is an object of this invention to provide a method of constructing an anchoring device accessible from only one side which does not encounter the mentioned drawbacks of prior art anchoring devices, i.e., an anchoring device wherein the tendons are held so that the tractive stress on each of them at the level of the anchoring device is taken over by adhesion, this adhesion being appreciably favored by the confinement induced by the overall shape of the anchoring device, and by longitudinal mechanical blocking of the ends of the tendons due to the particular shape of these ends and their arrangement in a cavity of substantially tapering shape.

A further object of the invention is to provide an anchor member of a particular shape which, associated with a plurality of tendons also having a particular shape, makes it possible to construct such an anchoring device.

Still another object of the invention is to enable the construction of such an anchoring device without the direct use of an anchor member.

SUMMARY OF THE INVENTION

To this end, the method of constructing an anchoring device according to the present invention, of the type initially mentioned, includes the steps of making a cavity in a surrounding structure, this cavity having a substantially oblong, tapering shape and having two ends, the area of the cross-section of the end disposed on the accessible side of the anchoring device being less than the area of the cross-section of another portion of the cavity, the cavity comprising an opening on the accessible side of the anchoring device; successively inserting through the opening of one end of each of the tendons, each of these tendons being made up of a traction rod having a first cross-sectional area and an end portion having a second cross-sectional area larger than the first cross-sectional area; and filling the cavity with an embedding material.

The anchor member according to the present invention is of a substantially oblong, tapering shape and has two ends, the area of the cross-section of a first end being less than the area of the cross-section of another portion of the anchor member, the anchor member being made up substantially of a wall bounding a cavity of a shape substantially similar to that of the anchor member and provided with an opening having a first cross-sectional area at the first end of the anchor member and comprising a bottom wall at the second end, another cross-section of the cavity having another area larger than the first area.

The tendon according to the present invention, of the type initially mentioned, is made up of a traction rod provided at the end thereof intended to be inserted in the cavity with an end portion, the area of the cross-section of which is larger than the area of the cross-section of the traction rod.

Figure 2B:
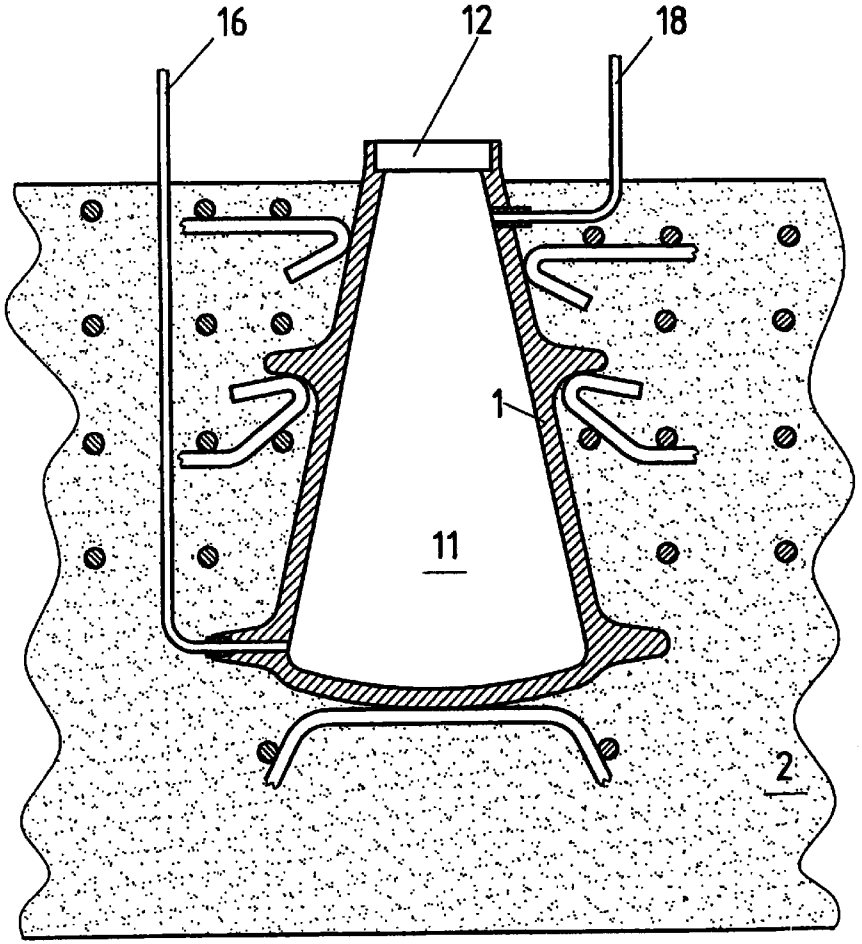
Figure 2A:
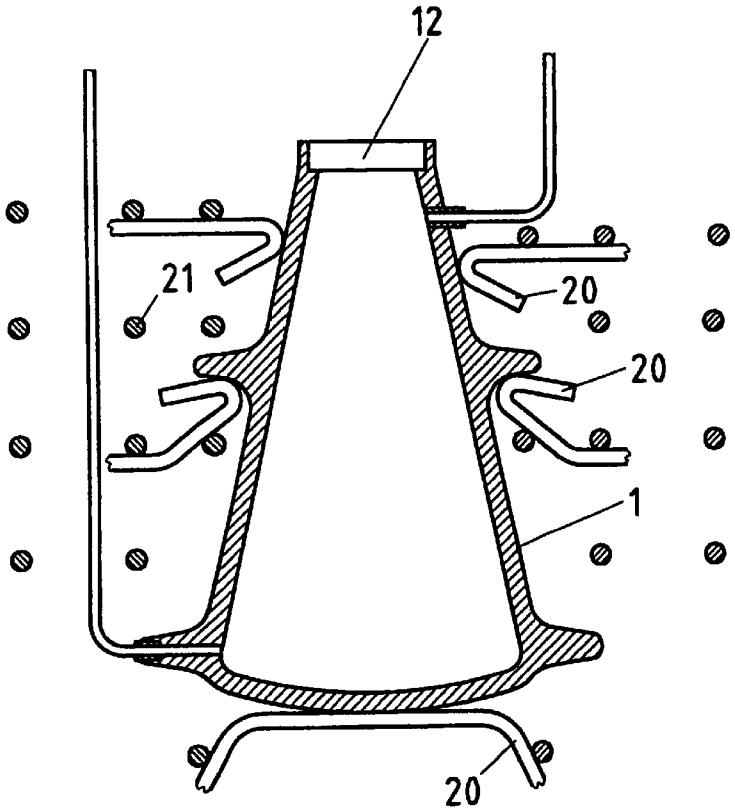
Figure 2D:
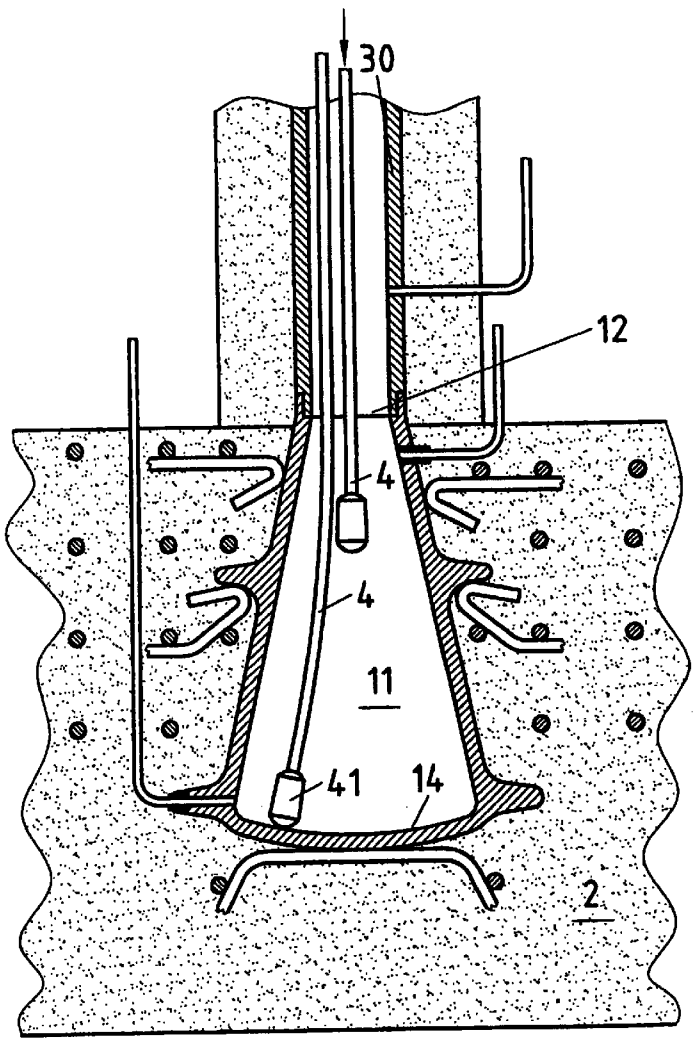
Figure 2C:
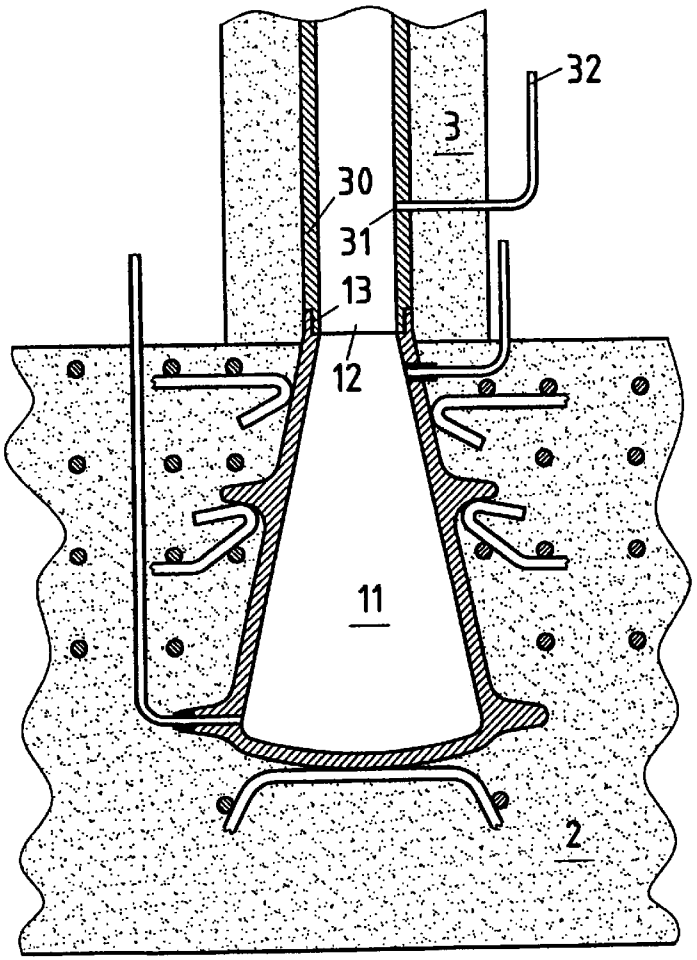
Figure 2F:
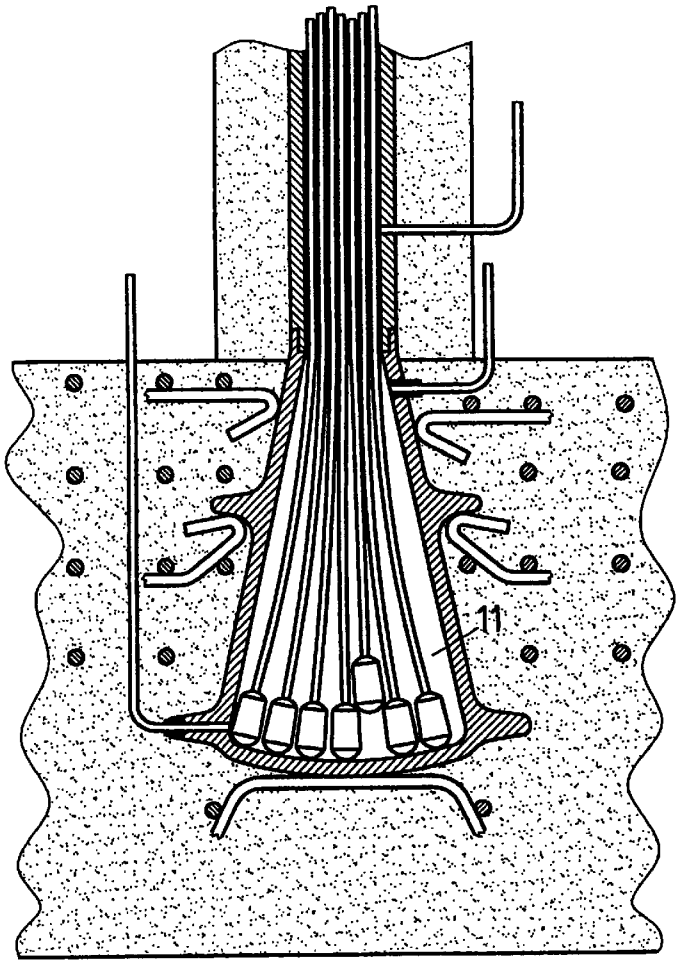
Figure 2E:
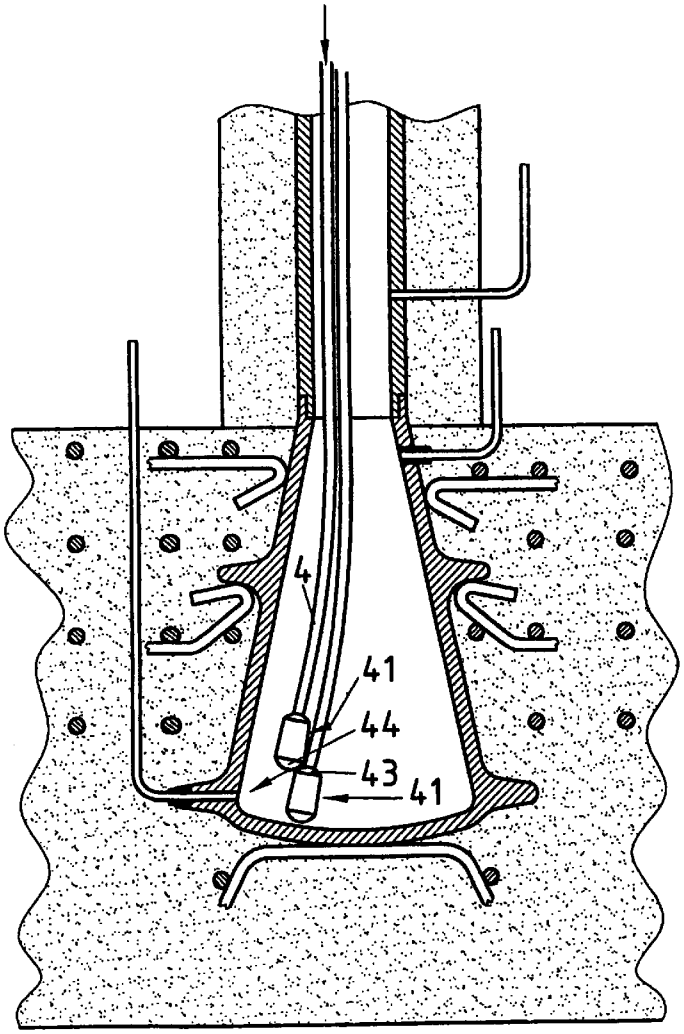
Figure 2H:
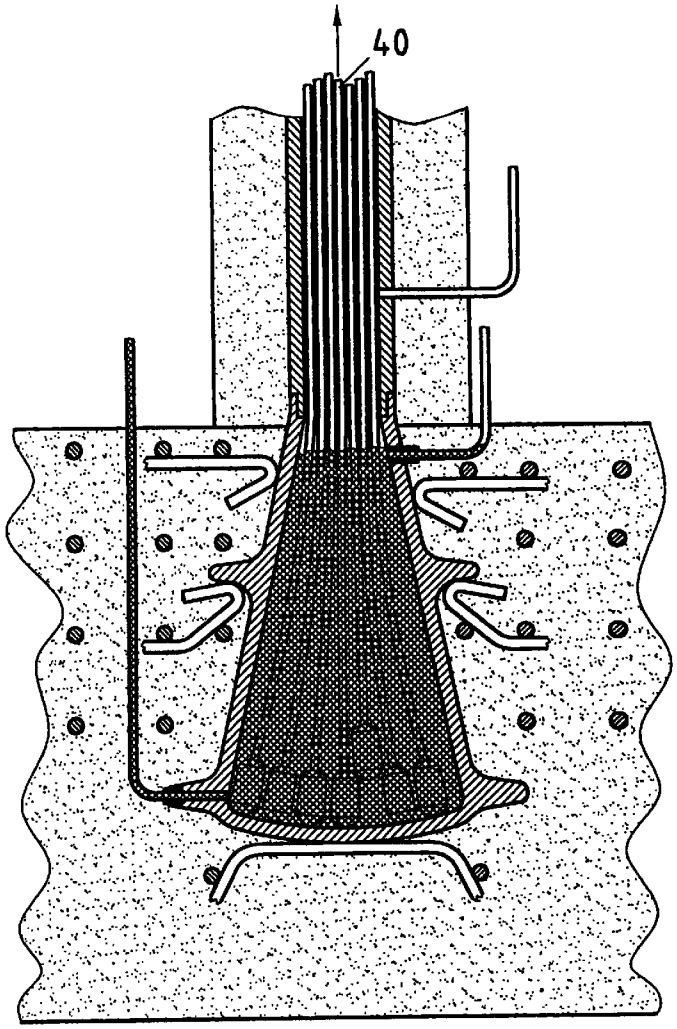
Figure 2G:
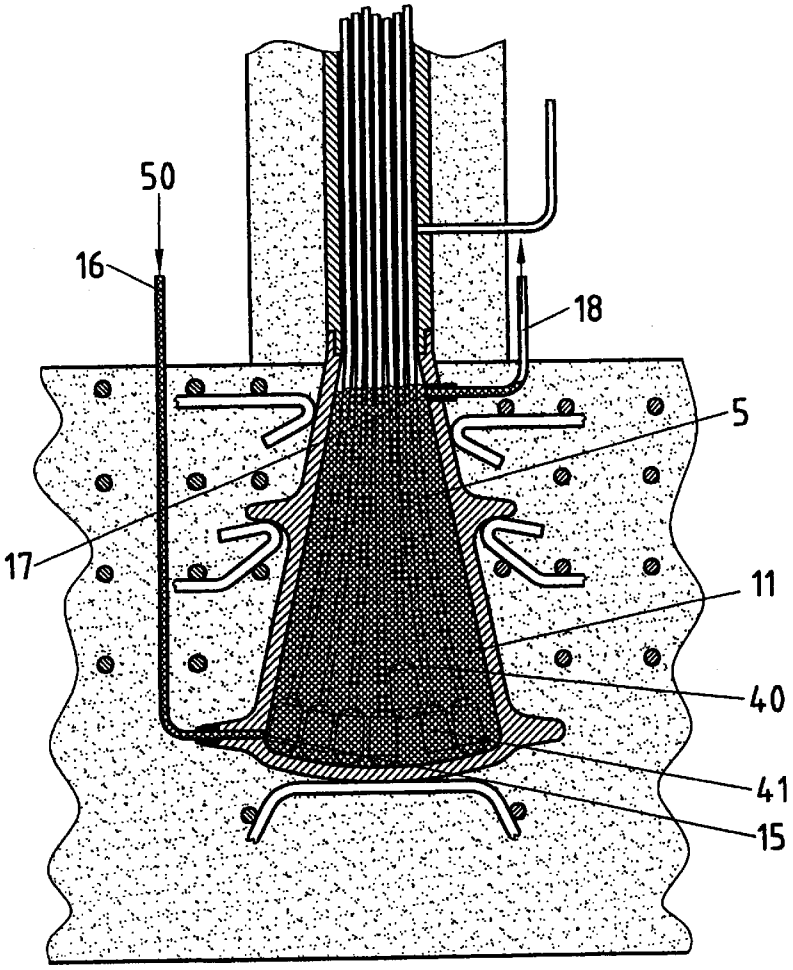
Figure 2L:
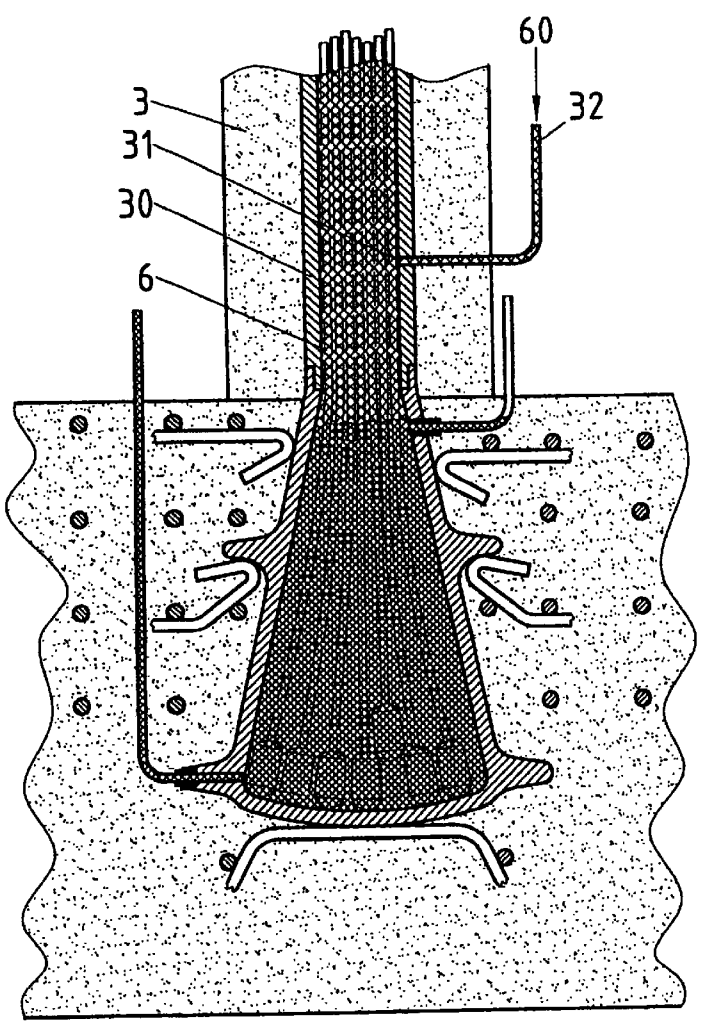
Figure 3A:
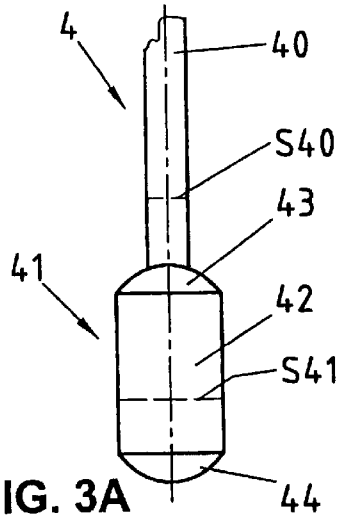
Figure 3B:
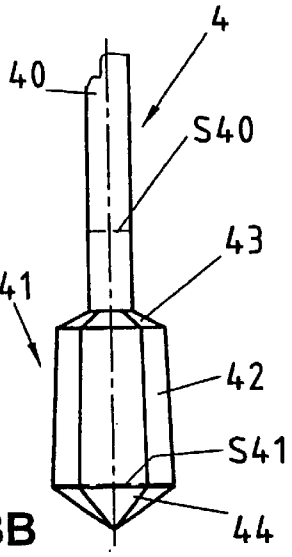
Figure 3C:
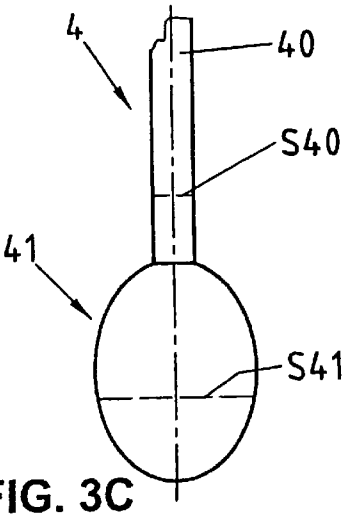
Figure 3D:
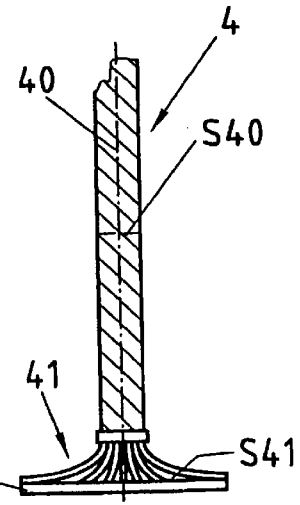

Preferred embodiments of the invention will now be described in detail with reference to the accompanying drawings, in which:

FIG. 1 is a sectional view of a preferred embodiment of an anchor member according to the invention, FIG. 2 is a series of sectional views (A-H,-L) representing steps in the method of constructing an anchoring device according to the invention, FIG. 3A is a diagrammatic elevation of part of a tendon in a first embodiment of the invention, FIG. 3B is a diagrammatic elevation of part of a tendon in a second embodiment of the invention, FIG. 3C is a diagrammatic elevation of part of a tendon in a third embodiment of the invention, and FIG. 3D is a diagrammatic view, partially in section, of part of a tendon in a fourth embodiment of the invention.

DETAILED DESCRIPTION OF THE PREFERRED EMBODIMENT

For carrying out the inventive method, an anchoring cavity of a certain shape must first be obtained. The shape of this anchoring cavity is substantially oblong and tapering, with a first open end on the accessible side of the anchoring device and a second closed end on the non-accessible side of the anchoring device. Moreover, the cross-section of the first end of the anchoring device must be smaller than another cross-section of the cavity, whether this section corresponds to that of the second end or to an intermediate section of the cavity.

Such a cavity may be obtained by several means or devices. A first means consists in using an anchor member comprising a prefabricated interior cavity having the required shape of the anchoring cavity. A preferred embodiment of such an anchor member is illustrated in FIG. 1. The anchor member 1 consists essentially of a preferably thin wall 10 bounding an interior cavity 11. A first end of the anchor member 1, i.e., the top end of the member as viewed in the drawing, includes an opening 12, as well as means 13 for fastening a tubular sheath for protecting tendons, the use of which will be described below. The other end of the anchor member 1 is closed by a bottom wall 14. The outside shape of the anchor member 1, hence of the interior cavity 11, is substantially tapering, e.g., frustoconical or frustopyramidal, with the smallest cross-section close to the opening 12 and the largest cross-section close to the bottom wall 14. An inlet 15 is disposed close to the bottom wall 14, an injection tube 16 being attached or attachable to inlet 15. Similarly, an outlet 17 is disposed close to the opening 12, an exhaust tube 18 being attached or attachable to the outlet 17. The use of elements 15–18 will be described below.

The tapering, frustoconical, or frustopyramidal outside surface of the anchor member 1 includes one or more anchor rings 19 disposed at the periphery of this surface, the purpose of which is to improve the transmission and distribution of the anchoring force to the surrounding structure. The embodiment shown in the drawing includes two such rings 19. The anchor member 1 may be made of synthetic material, of metal, or of concrete, its size depending essentially upon the extent of the anchoring device being considered.

FIG. 2A shows the first step in the inventive method of constructing an anchoring device using such an anchor member. While the surrounding concrete structure has not yet been made, an anchor member 1 is placed at the exact location where the anchoring device is to be constructed, the opening 12 being aimed in the direction of the future tendons. The anchor member 1 is held in place by temporary scaffolding or, preferably, by iron bars 20 of the concrete reinforcement. Preferably, although this is not indispensable to the invention, one or more circular iron bars 21, forming one or more hoops, are disposed about the anchor member 1 in order to improve the cohesion of the concrete at that location.

In FIG. 2B, it is seen that the concrete structure 2 intended to support the anchoring device has been conventionally poured about the anchor member 1. The anchor member 1 is thus completely surrounded and held in the concrete structure 2 except for its first end provided with the opening 12 which is flush with the top surface of the concrete structure 2 or, as shown here, projects slightly above that surface, and except for the ends of the injection tube 16 and exhaust tube 18, which remain accessible outside the concrete structure 2.

It will therefore be noted that in this second step of the method, a cavity 11 of a certain shape has been produced within a concrete structure 2. As described until now, the cavity 11 has been produced using an anchor member 1 provided with a prefabricated cavity. A like cavity 11 in a concrete structure 2 may also be produced in other ways, e.g., by fabricating it in situ. For instance, provision may be made for a form capable of being dismantled, made of wood or some other material, having an outside shape corresponding to the desired shape of the cavity 11, and placed at the required location, about which form the concrete structure 2 is subsequently poured. As soon as the concrete is hardened, the form is dismantled through the opening 12 and extracted from the cavity 11 through that same opening. In a rather similar manner, a flexible, inflatable component may be used, which after inflation has the desired shape of the cavity 11 and is placed at the required location. After the concrete structure 2 has been poured, the inflatable component is deflated, leaving a cavity 11 of the required shape in the structure 2. Another procedure would be to produce the cavity 11 by drilling out such a cavity of the required shape in an existing structure 2. This drilling procedure would be reserved for anchoring directly in the earth or else for the installation of a new anchoring device on an existing structure 2. The cavity 11, produced in any one of the ways described, has two important dimensions, a passage area of the opening 12 designated S12 and a maximum cross-sectional area designated S11 (see FIG. 1).

During the third step of the method, shown in FIG. 2C, the structural element 3 to be prestressed is placed or concreted, in a manner known per se, above the concrete structure 2, the structural element 3 preferably comprising a conduit or a sheathing tube 30, one end of which is situated opposite the opening 12 to be attached to the fastening means 13 adjoining the opening 12. The cross-section of the sheathing tube 30 or of the conduit contrived in the structural element 3 for the tendons corresponds substantially to the cross-section of the opening 12 of the cavity 11. The tube 30 or corresponding conduit includes at least one injection port 31 connected to an injection tube 32, at least one of the ports 31 preferably being disposed near the end of the tube 30 close to the opening 12, as well as at least one outlet connected to an exhaust tube, at least one of the outlets being disposed near the other end (not visible in the drawing) of the tube 30, hence near the structural element 3.

The fourth step, shown in FIG. 2D, consists in inserting the tendons. Here reference is made to FIGS. 3A–3D showing, by way of non-limiting examples, four designs of such a tendon 4. This tendon is substantially made up of a traction rod 40 and an end portion 41. The end portion 41 on the rod 40 is so designed that it has a cross-sectional area S41 larger than the cross-sectional area S40 of the traction rod 40, for reasons to be explained below. The other end of the rod 40 has no end portion of this kind and is made up for a normal anchoring device as known in the art.

The traction rod 40 may be of any known type, consisting either of an undivided strand or of a plurality of strands assembled helically in order to constitute a traction cable. The undivided strand or the strands assembled into the traction rod 40 may be of steel, preferably of a steel having high resistance to traction, or of synthetic material, e.g., carbon-fiber- or Kevlar-based.

The end portion 41 may be an end piece 41 of metal or synthetic material which is firmly fixed to the end of the traction rod 40. The choice of material of which piece 41 is made, as well as the way it is fixed to the traction rod 40, depend essentially upon the material and the manner in which the traction rod 40 is made. The end piece 41 essentially includes a central body 42 bounded by an upper portion 43 and a lower portion 44. The body 42 may have the shape of a right cylinder, with a circular cross-section as in FIG. 3A or a polygonal cross-section, or else a frustoconical or frustopyramidal tapering shape, with a circular cross-section or a polygonal one as shown in FIG. 3B. In the case of a tapering shape, the part with the smaller cross-section is that adjacent to the upper portion 43. The two portions 43 and 44 are preferably domed or formed of inclined planes so as to facilitate the sliding of an end portion being installed on another end portion already installed, as will be seen below.

In another design, the end portion 41 may be formed by deformation or machining directly on the end of the traction rod 40. FIGS. 3C and 3D show examples of end portions of this type. In FIG. 3C, the traction rod 40 is made up of an undivided strand, and the end portion 41 is obtained by deformation, e.g., by forging, dieing, or stamping, of the end of the traction rod 40. FIG. 3D shows an example of an end portion 41 on a traction rod 40 made up of assembled strands. In this example, the end of each strand has been displaced from its normal position, it being possible to provide a ring or a binding just before this displacement in order to prevent the rest of the traction cable from untwisting. The displaced ends of the strands may be held in position by a supplementary holding part 45, e.g., a circular disk soldered or fixed in any other way under the displaced strands, or they may be left free. In a design not shown, the part for holding the displaced strands may consist of an element having the shape of two conical portions coupled at their bases, a first conical portion being inserted between the strands to displace them, while the second conical portion is used for the same purpose as the lower portion 44 described above. Thus, in any design of the end portion 41, it may also have a circular or polygonal shape and include upper and lower portions 43 and 44, as described previously.

The described examples of end pieces 41 or of deformed end portions 41 are not limiting as regards either their shape or the way in which they are produced; any means may be envisaged for increasing the area of the cross-section of the end portion of the traction rod 40. When the following description speaks of end piece 41, it shall be understood that this may also be an end portion as described above.

Returning to FIG. 2D, it will be seen that a first tendon 4 has been pushed into the guide tube 30, then into the cavity 11, until its end piece 41 comes in contact with the bottom surface of the cavity 11. A second tendon 4 is being installed in the same way.

FIG. 2E shows the usefulness of the domed or inclined shape which may be provided on the upper and lower portions 43, 44 of the end piece 41. When a tendon 4 is being installed, it is quite possible for its end piece 41 to come up against another end piece of a tendon already installed. Owing to the domed or inclined shape of these portions, the second end piece does not jam against the first one but is moved away from it and slides against it until it arrives at its final position beside the first piece.

FIG. 2F shows that after a number of tendons have been installed, a new end piece to be installed may not have room at the bottom of the cavity 11; in that case, in order for the tendon in question to play its full part later on, it suffices if the end piece is pushed down as far as possible in the cavity until it comes up against one or more pieces already installed or against the sidewall of the cavity.

In order to anchor the guying or the prestressed element, a certain number N of tendons 4 must be inserted in the cavity 11. Knowing that the cross-section of each traction rod 40 has an area S40 and that the maximum area of the cross-section of the end piece 41 equals S41 (see FIGS. 3A, 3B, 3C, and 3D), the following relations should exist:

to allow the insertion of the last tendon 4, i.e., to allow the last end piece 41 to pass into the guide tube 30 and into the opening 12:

$$[(N-1)\times S40]+S41<S12$$

wherein S12 is the area of the cross-section of the opening 12 (FIG. 1).

to allow the end pieces 41 to be disposed properly on the bottom of the cavity 11:

$$(N\times S41)<S11$$

wherein S11 is the area of the cross-section of the cavity 11 having the largest area (FIG. 1).

When all the tendons 4 have been pushed through the conduit of the tube 30 so that all their end pieces 41 are accommodated in the cavity 11 as indicated above, the next step may be undertaken as shown in FIG. 2G. During this step, a liquid embedding material 50 is inserted through the injection tube 16; this embedding material enters the cavity 11 through the inlet 15 and fills the empty spaces between the end pieces 41 and the ends of the traction rods 40 in the cavity 11 until it fills the cavity 11 at least partially. During this operation, the outlet 17 and the exhaust tube 18 serve to exhaust the air contained in the cavity 11 during its filling, as well as to check the filling level of the cavity 11. The cavity 11 is preferably filled until the liquid mass inserted reaches the level of the outlet 17. The embedding material contained in the cavity 11 then hardens into a rigid block 5 of high mechanical strength in which the end pieces 41 and the ends of the traction rods 40 are encased.

In the following step, shown in FIG. 2H, each of the tendons 4 is subjected to traction until the prescribed prestresssing tension is reached. This application of traction takes place in a conventional manner by acting on the other end of each tendon 4, i.e., of each traction rod 40, the tendons being pretightened simultaneously or in sequence. As may be seen in the drawing, the frustoconical or pyramidal tapering shape of the cavity 11, hence of the hardened mass in which the end pieces 41 and the ends of the rods 40 of the tendons 4 are encased, permits efficient wedge-shaped anchoring in the surrounding concrete structure. Contrary to the prior art devices mentioned earlier, this wedge shape prevents any possible axial movement of the hardened mass 5 and causes transmission of the anchoring forces into the surrounding structure 2 by axial compression and not by simple adhesion. The length of this anchoring device is therefore favorably reduced.

Additional anchoring security is ensured by the particular arrangement of the end pieces 41 within the cavity 11. Considering that the end pieces 41 are disposed in a bundle in the cavity 11, the area of the cross-section generated by the casing of the bundle of assembled end pieces 41 is greater than the area of the opening 12 of the cavity 11. The bundle of end pieces 41 is therefore blocked in the cavity 11.

Reverting to the expressions given above, for enabling blockage of the tendons 4 in the cavity 11 by preventing the mutually blocked end pieces 41 from coming out through the opening 12, the relation should be:

$$(N\times S41)^*>S12$$

wherein (N×S41)* represents generally the surface generated by the casing of the bundle of the N assembled end pieces, each having a cross-sectional area S41. In order to take into account that one or two end pieces 41 may possibly not have found their proper place, as indicated with respect to FIG. 2H, the individual sections S41 and the passage section S12 must be of a size to block the end pieces 41 when the tractive force is exerted simultaneously on all the tendons 4.

It should be noted that the step of pretightening the tendons 4 as just described may be carried out differently, especially in the case of simple guying, not pretightened.

In a final step of the method, illustrated in FIG. 2L, the empty space within the sheathing tube 30, or within the conduit made in the structural element 3, may be filled with a sealant 60 through the injection tube or tubes 32 and the inlet or inlets 31 in order to preserve the fluid-tightness of the pretightened system and to prevent corrosion of the pretightening elements. This last step is also optional, depending upon whether such protection 6 is required or necessary.

It will therefore be noted that a very effective anchoring device is thus obtained, the longitudinal tractive force of each tendon 4 being taken over mainly by its end piece or portion 41 and transferred to the hardened block 5 of embedding material having high mechanical strength. Efficient transmission of this force is possible owing to the firm attachment of the end piece 41 on the traction rod 40; since this attachment may take place in the factory, its mechanical strength is very high. This force is then transferred by the oblique walls of the cavity 11 to the surrounding structure 2. By disposing one or more anchor rings on the anchor member 1, it is even possible to improve the mentioned anchoring effect in the surrounding structure 2. As mentioned, hoops 21 may be provided in order further to improve the cohesion of the surrounding structure 2 about the cavity 11. In addition to the mentioned longitudinal strength—each end of a traction rod 40 being held in the block 5 of embedding material—each rod 40 is held by radial compression as well.

This type of anchoring device lends itself particularly well to prestressed anchoring of a prestressed structural element 3. It may also lend itself to anchoring of non-prestressed tendons, e.g., guys for staying a mast or pylon, in which case the guys need not be protected by a protective tube 30. Likewise, it is not indispensable for the cavity 11 to be contrived in a surrounding structure of concrete; a borehole in the earth or in rock whereby a cavity as required may be obtained might be provided instead.

The foregoing description pertains to a cavity having a substantially vertical longitudinal axis, with its opening 12 at the top. Other geometric arrangements are also possible; the dimensions of the cavity 11 are to be adapted in order to obtain sufficient filling of the cavity 11 by the embedding material 50.

What is claimed is:

1. A method for constructing an anchoring device, having a plurality of tendons extending from an opening therein which is accessible from only one side thereof, in a structure, comprising the following steps:

making a cavity in the structure, said cavity having a substantially oblong, tapering shape with two ends, the first end comprising the opening, a cross-sectional area of the first end being smaller than a cross-sectional area of another portion of the cavity;

installing or concreting a prestressed structural element comprising a longitudinal conduit for the passage of the tendons, one end of said longitudinal conduit communicating with the opening provided in the cavity of the anchoring device;

successively inserting a second end of each of the plurality of tendons through the longitudinal conduit and into the cavity through the opening, each of the plurality of tendons comprising a traction rod having a first end with a first cross-sectional area which extends from the opening and having at the second end thereof an end portion with a second cross-sectional area larger than said first cross-sectional area; and filling the cavity with an embedding material.

2. The method according to claim 1, wherein the cavity-making step is performed by:

installing a substantially oblong, tapering anchor member having two ends, the first end comprising the opening, a cross-sectional area of the first end being smaller than a cross-sectional area of another portion of the anchor member, said anchor member comprising a wall bounding the cavity and comprising a bottom wall at the second end; and embedding or concreting the anchor member in the structure, leaving said opening free.

3. The method according to claim 1, wherein the cavity-making step is performed by:

installing a template having a substantially oblong and tapering outside shape;

concreting the structure about said template; and dismantling the template by one of its ends, leaving the cavity of substantially oblong and tapering shape in the structure, having the opening.

4. The method according to claim 1, wherein the cavity-making step is performed by:

installing an inflatable flexible part which, once inflated, has a substantially oblong and tapering shape;

concreting the structure about said part in its inflated state; and deflating and removing the part, leaving the cavity of substantially oblong and tapering shape in the structure, having the opening.

5. The method according to claim 1, wherein the cavity-making step is performed by:

boring the cavity of substantially oblong and tapering shape in the structure.

6. The method according to claim 1, comprising, after the cavity-filling step, a step of tightening each of the plurality of tendons.

7. The method according to claim 6, comprising, after the tendon-tightening step, a step of filling the longitudinal conduit of the prestressed structural element with a sealant.

8. A method for constructing an anchoring device, having a plurality of tendons extending from an opening therein which is accessible from only one side thereof, in a structure, comprising the following steps:

making a cavity in the structure, said cavity having a substantially oblong, tapering shape with two ends, the first end comprising the opening, a cross-sectional area of the first end being smaller than a cross-sectional area of another portion of the cavity including a largest cross-sectional area of the cavity;

installing or concreting a prestressed structural element comprising a longitudinal conduit for the passage of the tendons, one end of said longitudinal conduit communicating with the opening provided in the cavity of the anchoring device;

successively inserting a second end of each of the plurality of tendons through the longitudinal conduit and into the cavity through the opening, each of the number X of tendons comprising a traction rod having a first end with a first cross-sectional area which extends from the opening and having at the second end thereof an end portion with a second cross-sectional area larger than said first cross-sectional area;

repeating the preceding step up to the plurality of tendons such that the plurality less one of tendons multiplied by the first cross-sectional area of the first end of the traction rod, the product of which when added to the cross sectional area of the second end of the rod is less than the first cross-sectional area of the first end of the cavity; and filling the cavity with an embedding material.

9. The method according to claim 8, comprising repeating the step of successively inserting a second end of each of the plurality of tendons through the longitudinal conduit and into the cavity through the opening such that the plurality of tendons multiplied by the cross sectional area of the second end of the rod is less than the largest cross-sectional area of the cavity.

10. The method according to claim 8, comprising repeating the step of successively inserting a second end of each of the plurality of tendons through the longitudinal conduit and into the cavity through the opening up to the point where the plurality of tendons multiplied by the first cross-sectional area is greater than of the first cross-sectional area of the first end of the cavity.

* * * * *